US006928692B2

(12) United States Patent
Oh et al.

(10) Patent No.: US 6,928,692 B2
(45) Date of Patent: Aug. 16, 2005

(54) CYCLONE-TYPE DUST COLLECTING APPARATUS FOR VACUUM CLEANER

(75) Inventors: Jang-keun Oh, Gwangju (KR); Hyoung-jong Jin, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 256 days.

(21) Appl. No.: 10/241,998

(22) Filed: Sep. 12, 2002

(65) Prior Publication Data

US 2003/0208879 A1 Nov. 13, 2003

(30) Foreign Application Priority Data

May 11, 2002 (KR) ..... 2002-26043

(51) Int. Cl.[7] ..... A47L 9/20; B01D 46/48

(52) U.S. Cl. ..... 15/352; 55/298; 55/299

(58) Field of Search ..... 15/327.1, 327.2, 15/327.6, 327.7, 347, 350, 351, 352, 353; 55/295, 297–299, 304, 337, DIG. 3

(56) References Cited

U.S. PATENT DOCUMENTS

| | | | | | |
|---|---|---|---|---|---|
| 786,549 | A | * | 4/1905 | Dion | 210/413 |
| 2,171,248 | A | * | 8/1939 | Van Berkel | 55/392 |
| 3,797,064 | A | * | 3/1974 | MacFarland | 15/351 |
| 3,979,194 | A | * | 9/1976 | Wiser | 55/296 |
| 5,271,751 | A | * | 12/1993 | Lagler | 55/295 |
| 5,603,740 | A | | 2/1997 | Roy | |
| 6,195,835 | B1 | | 3/2001 | Song et al. | |
| 2001/0025395 | A1 | | 10/2001 | Matsumoto et al. | |
| 2003/0159235 | A1 | | 8/2003 | Oh | |

FOREIGN PATENT DOCUMENTS

| | | | |
|---|---|---|---|
| DE | 970604 | | 10/1958 |
| DE | 1059636 | | 6/1959 |
| DE | 19704468 | | 8/1998 |
| EP | 1136028 | | 9/2001 |
| FR | 2558712 | * | 8/1985 |
| WO | WO9834714 | | 8/1998 |
| WO | WO0132066 | | 5/2001 |

* cited by examiner

*Primary Examiner*—Terrence R. Till
(74) *Attorney, Agent, or Firm*—Ladas & Parry LLP

(57) ABSTRACT

A cyclone-type dust collecting apparatus having a dust removing portion for removing from the grill portion the dust and foreign substances that become attached to the grill portion of the grill member while the grill portion is rotated by the vortex air of the cyclone body. The dust removing portion includes rotating means disposed at a lower portion of the grill member for rotation by an air current passing therethrough; a rotary member rotatably connected to the rotating means, and disposed separate from an end of the grill member by a predetermined distance; and a brush member having one side connected to the rotary member and the other side being disposed in contact with the grill portion of the grill member for removing the dust and foreign substances from the grill portion. As the cleaning operation starts, the brush member inside of the cyclone-type dust collecting apparatus is rotated by the vortex current generated therein, to remove dust or contaminants from the grill portion of the grill member. Accordingly, clogging of the grill portion of the grill member is prevented, and as a result, deterioration of the suction force and overload of the motor can be inhibited.

8 Claims, 4 Drawing Sheets

CYCLONE-TYPE DUST COLLECTING APPARATUS FOR VACUUM CLEANER

BACKGROUND OF THE INVENTION

1. Field of the Invention

The present invention relates to a vacuum cleaner, and more particularly, to a cyclone-type dust collecting apparatus for use in a vacuum cleaner to separate dust from dust-laden air by a centrifugal force.

2. Description of the Prior Art

FIG. 1 schematically shows the structure of a general cyclone-type dust collecting apparatus for use in a vacuum cleaner. The general cyclone-type dust collecting apparatus will be described below with reference to commonly assigned U.S. Pat. No. 6,195,835 and FIG. 1.

As shown in FIG. 1, the general cyclone-type dust collecting apparatus for use in vacuum cleaner includes a cyclone body 20, a dust receptacle 30 and a grill member 40.

The cyclone body 20 includes a first connecting pipe 21, connected with an extension pipe 1*a* at a suction port side, a second connecting pipe 22 connected to an extension pipe 1*b* at a cleaner body side, an air inlet 23 interconnected with the first connecting pipe 21, and an air outlet 24 interconnected with the second connecting pipe 22. The cyclone body 20 forms a vortex from the dust-laden air that is drawn into the cleaner through the air inlet 23.

The dust receptacle 30 is removably connected to the cyclone body 20, and collects the dust and foreign substances separated from the air by the vortex formed in the cyclone body 20.

The grill member 40 is disposed at the air outlet 24 of the cyclone body 20, to prevent the reverse flow of the dust that is collected in the dust receptacle 30. The grill member 40 includes a grill body 41, a plurality of fine holes 42 formed in an outer circumference of the grill body 41 to form a flow passage interconnecting with the air outlet 24, and a conical reverse preventing plate 43 formed at a lower end of the grill body 41.

In the general cyclone-type dust collecting apparatus for use in a vacuum cleaner constructed as above, dust-laden air is drawn into the cyclone body 20 through the first connecting pipe 21 by the suction force generated at the suction port of the vacuum cleaner. The air is drawn into the cyclone body 20 in a diagonal direction with respect to the cyclone body 20, thereby forming a vortex current in the cyclone body 20 that descends down to the bottom of the dust receptacle 30 (shown by a solid-lined arrow in FIG. 1). During this process, dust is separated by the centrifugal force of the vortex, and is collected in the dust receptacle 30.

Then, by the air current turning from the bottom of the dust receptacle 30, the air is passed through the fine holes 42 of the grill member 40, the air outlet 24 and the second connecting pipe 22, and then discharged into the cleaner body (shown by a dot-lined arrow in FIG. 1). As the air is turning upward in the dust receptacle 30, some dust comes into contact against the reverse preventing plate 43 and is returned back into the vortex current. Some dust, which is not separated from the upward air current, is filtered and returned back to the vortex current as the dust-laden air is discharged through the fine holes 42 of the grill member 40.

Some dust, which is still not separated from the air, is discharged together with the air through the fine holes 42 of the grill member 40 and the air outlet 24. The dust is then filtered out at a paper filter of the cleaner body, and the clean air is discharged outside via the motor.

Above-described cyclone-type dust collecting apparatus for use in the vacuum cleaner, however, have some problems. That is, as the dust-laden air is discharged through the fine holes 42 of the grill member 40, some of dust is attached to the grill member 40, eventually clogging the fine holes 42 of the grill member 40. When the fine holes 42 are clogged, efficiency decreases due to suction force deterioration, while the motor of the vacuum cleaner is subjected to an overload. Accordingly, the dust at the fine holes 42 of the grill member 40 has to be removed. In the general cyclone-type dust collecting apparatus, since the grill member 40 is connected to the cyclone body 20, a user has to disconnect the dust receptacle 30 from the cyclone body 20 in order to remove the dust from the grill member 40. When the user separates the dust receptacle from the cyclone body 20, the grill member 40 is exposed to the environment outside the dust receptacle, and the user has to use hands or a brush to perform a cleaning operation for removing the dust. Accordingly, the dust removing job becomes tricky, while the surrounding environment is polluted by the dust floating in the air during the process of removing the dust from the grill member 40.

SUMMARY OF THE INVENTION

Accordingly, it is an object of the present invention to provide a cyclone-type dust collecting apparatus for use in a vacuum cleaner capable of automatically removing dust from a grill member when a predetermined amount of the dust becomes attached to the grill member while being rotated in a vortex current within the cyclone-type dust collecting apparatus, thereby preventing blockage of a flow passage by the dust and also eliminating separate cleaning operation for dust-removal by a user.

The above object is accomplished by a cyclone-type dust collecting apparatus having a dust removing means for removing dust and foreign substances that become attached to the grill portion of the grill member while the grill portion is being rotated by the vortex within the cyclone body.

The dust removing means includes rotating means disposed at a lower portion of the grill member for rotation by an air current passing therethrough; a rotary member rotatably connected to the rotating means, and disposed separate from an end of the grill member by a predetermined distance; and a brush member having one side connected to the rotary member, and another side being disposed in contact with the grill portion of the grill member, for removing the dust and foreign substances from the grill portion.

According to the preferred embodiment of the present invention, the rotating means includes a cylinder body press-fit in a lower side of the grill member; a rotary fan rotatably supported within the cylinder body; and a first and a second supporting portions for supporting both ends of the rotary fan in the cylinder body. The first and the second supporting members comprise at least two ribs and first and second shaft holes formed at a hub defined by the center portions of the ribs for supporting the shaft of the rotary fan, the first supporting member being integrally formed with one end of the cylinder body and the second supporting member removably connected in an insertion hole formed inside of the other end of the cylinder body. The first and the second supporting members preferably comprise three ribs arranged at even intervals.

The rotary member is formed in the shape of a conical rotary plate that also functions as a reversal-prevention plate that reflects the contaminants of the upwardly rising air back into the vortex of the cyclone-type dust collecting apparatus.

The conical rotary plate has a connecting hole formed at a center through which an end of the shaft of the rotary fan is press-fit.

The brush member comprises a lever portion connected to the rotary member, and a brush portion connected to an end of the lever portion. More preferably, the brush member comprises at least two brush members that are disposed oppositely each other. Preferably, a resilient member is further disposed to provide resilient bias to the brush portion so as to push the two brush members toward tight contact with the grill portion of the grill member. Although it is preferable that the resilient member is a rubber ring, it should not be considered as limiting.

According to the preferred embodiment of the present invention, the grill member includes a first grill body substantially in the shape of a cone, and having a supporting portion supported in the air outlet of the cyclone body; a second grill body substantially in the shape of a cone having an open portion and a closed portion extending from the first grill body, with an outer circumference of the open portion and the closed portion being open and closed, respectively, along a radial direction, the open outer circumference of the open portion of the second grill body being covered with a net screen, thereby forming a grill portion having a plurality of fine holes defined therein.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF THE PREFERRED EMBODIMENT

Figure 1:
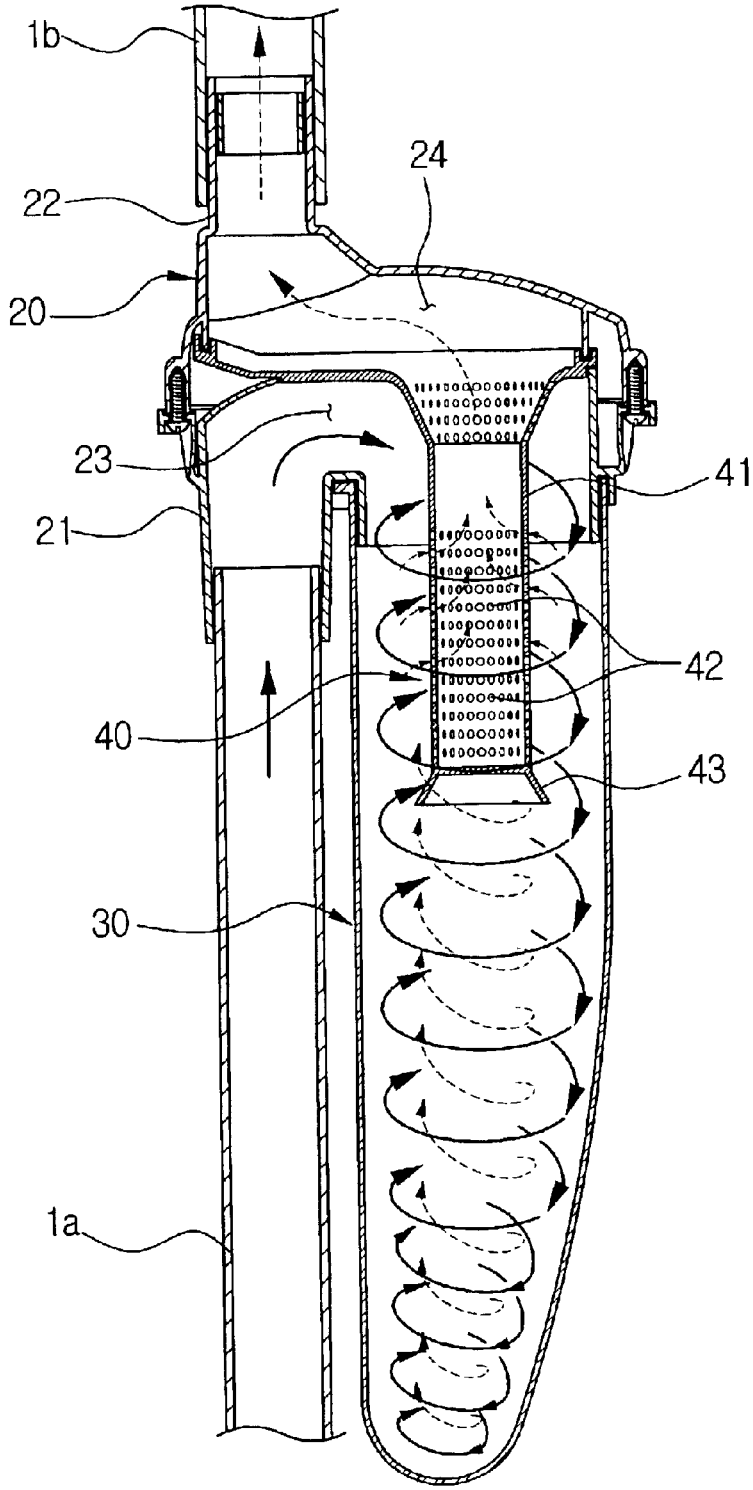
FIG. 1 (PRIOR ART)
FIG. 1 is a sectional view showing the structure of operation of a conventional cyclone-type dust collecting apparatus for use in a vacuum cleaner.

The present invention will be described in greater detail with reference to the accompanying drawing FIGS. 2–4. Throughout the description, like elements with similar structure and functions will be given the identical reference numerals.

Figure 2:
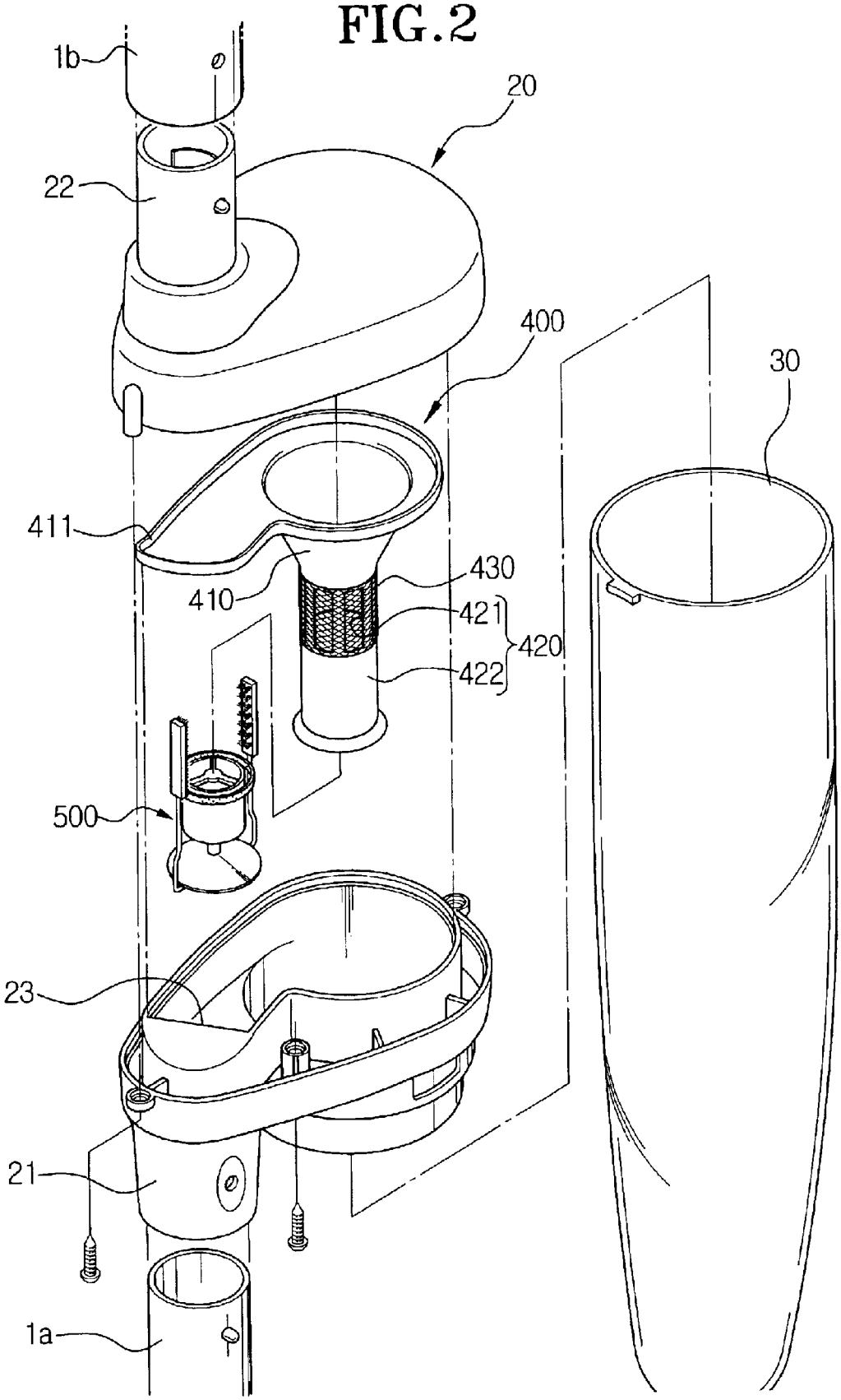
FIG. 2 is an exploded perspective view showing the structure of a cyclone-type dust collecting apparatus for use in a vacuum cleaner according to the preferred embodiment of the present invention.

As shown in FIG. 2, the cyclone-type dust collecting apparatus according to the preferred embodiment of the present invention includes a cyclone body 20, a dust receptacle 30, a grill member 400 and a dust removing means 500.

Figure 4:
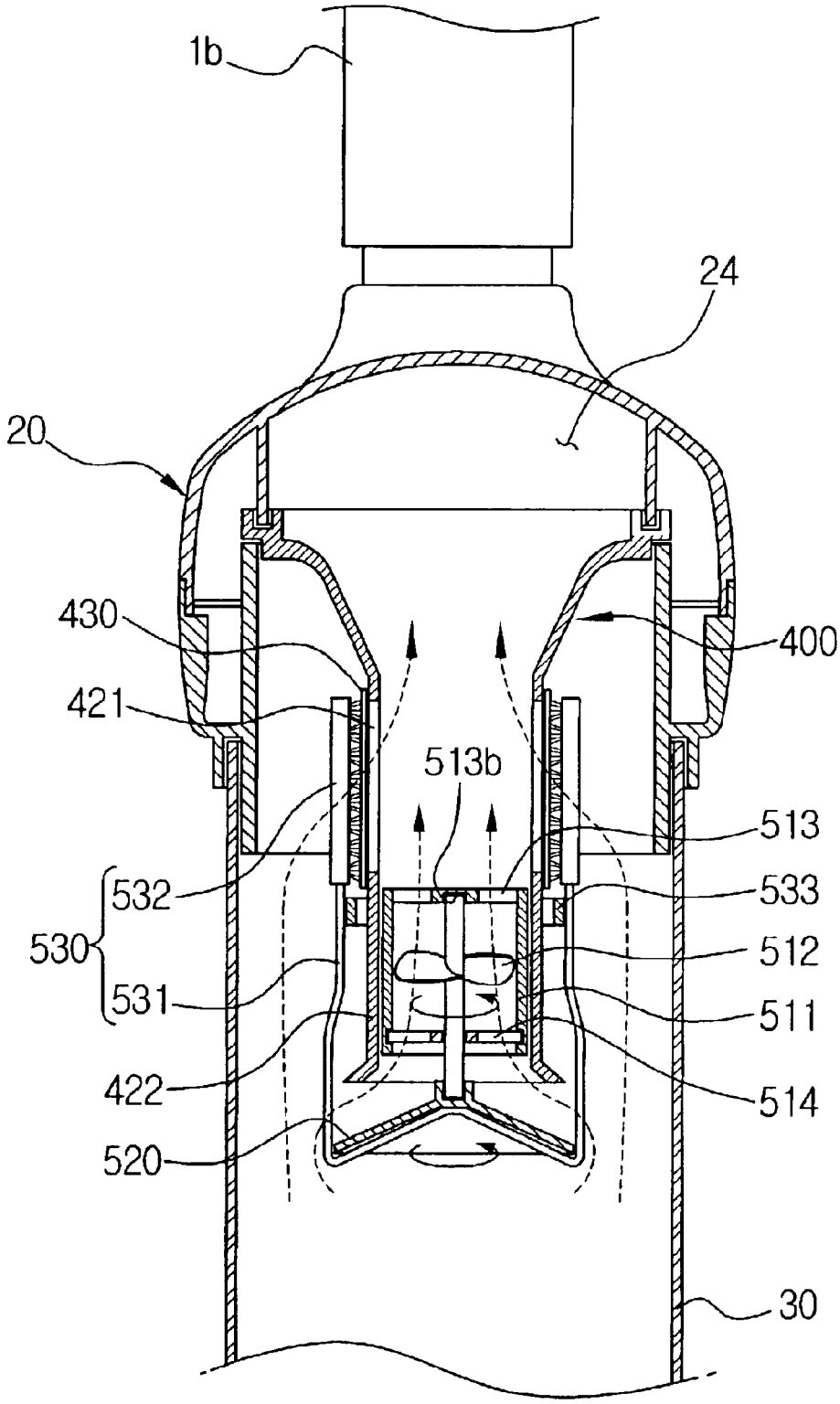
FIG. 4 is a sectional view for showing the operation of the cyclone-type dust collecting apparatus according to the preferred embodiment of the present invention.

As shown in FIGS. 2 and 4, the cyclone body 20 includes a first connecting pipe 21 connected with an extension pipe 1*a* at a suction port side, a second connecting pipe 22 connected with an extension pipe 1*b* at a cleaner body side, an air inlet 23 interconnected with the first connecting pipe 21 and an air outlet 24 interconnected with the second connecting pipe 22.

The dust-laden air, drawn in through the suction port of the vacuum cleaner, is drawn into the cyclone body 20 through the first connecting pipe 21 and the air inlet 23 in a diagonal direction with respect to the cyclone body 20. As the air is drawn into the cyclone body 20 in a diagonal direction, the air is turned into the vortex current, and, with the centrifugal force of the vortex current, the dust is separated from the dust-laden air.

The dust receptacle 30 is removably connected to the cyclone body 20, and contributes to the generation of vortex in cooperation with the cyclone body 20. The dust receptacle 30 also collects the dust and contaminants separated from the dust-laden air by the centrifugal force.

The grill member 400 is disposed at the air outlet 24 of the cyclone body 20 to prevent the dust collected in the dust receptacle 30 from reverse flow through the air outlet 24. The grill member 400 includes a first grill body 410, a second grill body 420 and a grill portion 430.

The first grill body 410 has a supporting portion 411 supported at the air outlet 24 of the cyclone body 20. The first grill body 410 has the shape of a cone that has a decreasing diameter from top to bottom. The second grill body 420 is extended from the lower portion of the first grill body 410, and has an open portion 420, an outer circumference of which is open in a radial direction, and a closed portion, an outer circumference of which being closed in a radial direction. The grill portion 430 is formed of a net screen disposed around the circumference of an open portion 421 of the second grill body 420, and defines a passage comprising plural fine holes. The open portion 421 is interconnected with the air outlet 24 of the cyclone body 20. Many other alternatives are also possible for the structure of the grill portion 430. For example, the grill portion 430 can be formed with the plural fine holes penetrated at locations that correspond to the second grill body 420.

The upturning vortex current in the dust receptacle 30 is discharged to the air outlet 24 of the cyclone body 20 via the grill portion 430 of the grill member 400. At this time, some of the dust or foreign substances of the air current become attached to the grill portion 430, thereby blocking the grill portion 430. The dust removing means 500 prevents the clogging of the grill portion 430 due to the dust or foreign substances attached to the grill portion 430 as the dust removing means 500 removes such dust or foreign substances while being rotated by the vortex current.

Figure 3:
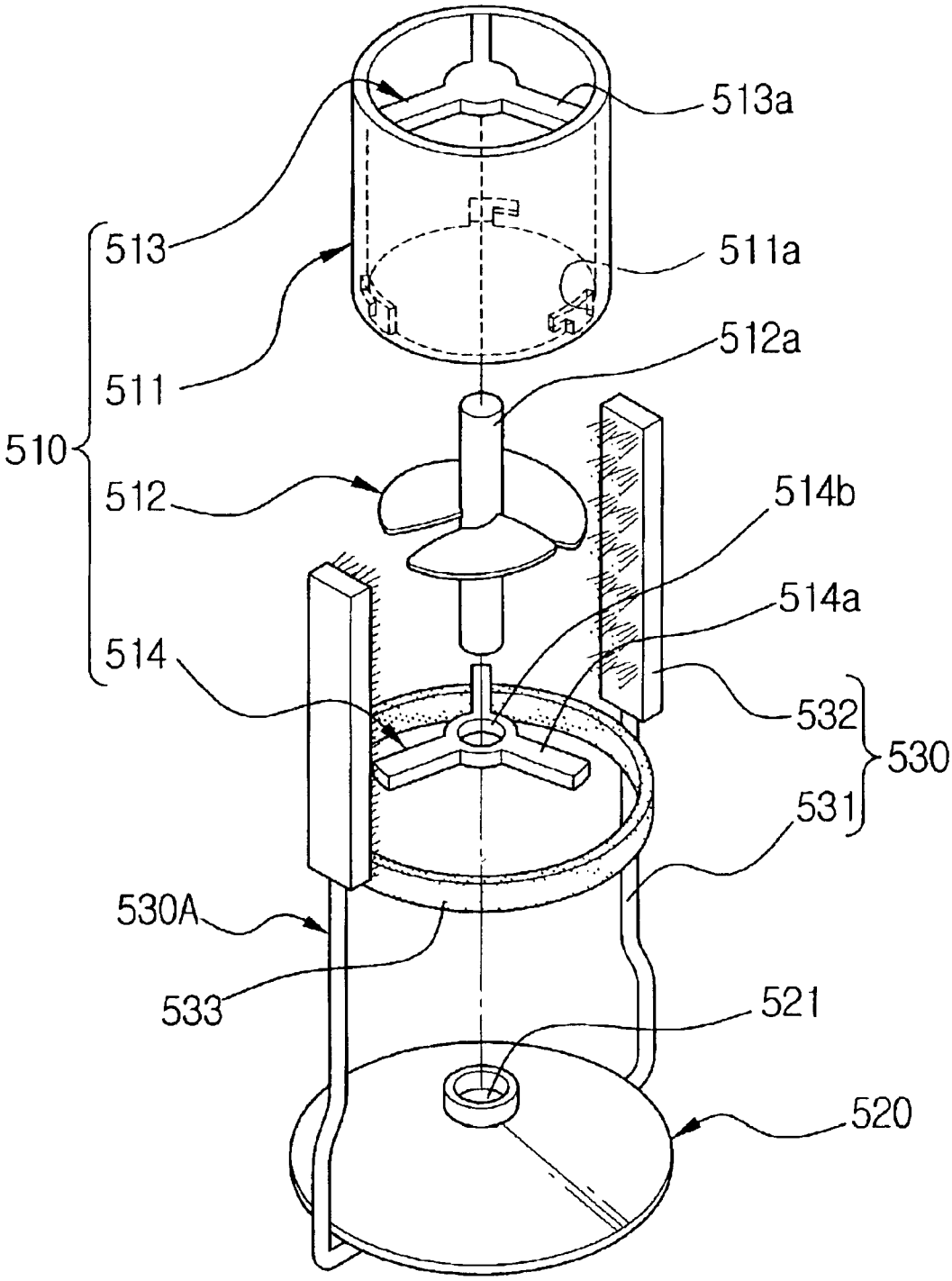
FIG. 3 is an exploded perspective view showing the main structure of the cyclone-type dust collecting apparatus for use in the vacuum cleaner of FIG. 2 according to the preferred embodiment of the present invention.

As shown in FIGS. 3 and 4, the dust removing means 500 includes a rotating means 510, a rotary member 520 and a brush member 530.

The rotating means 510 is rotatably disposed at the lower portion of the grill member to be rotated by the air current passing therethrough, and includes a cylinder body 511, a rotary fan 512, a first supporting member 513 and a second supporting member 514. The cylinder body 511 is press-fit in the closed portion 422 of the second grill body 420. The rotary fan 512 is rotatably disposed in the cylinder body 511. Both ends of a shaft 512*a* of the rotary fan 512 are supported in the cylinder body 511 by the first and the second supporting members 513, 514, so that the rotary fan 512 is rotated within the cylinder body 511 by the air current passing therethrough. The first and the second supporting members 513, 514 are provided with at least two, and preferably three ribs 513*a*, 514*a*. The ribs 513*a*, 514*a* are provided to surround first and a second shaft holes 513*b*, 514*b*, respectively, formed at the centers through which both ends of the shaft 512*a* are inserted. The first supporting member 513 is integrally formed with an end (upper end in FIG. 3) of the cylinder body 511, and the second supporting member 514 is removably connected to the other end (lower end in FIG. 3) of the cylinder body 511. For this purpose, the cylinder body 511 has three insertion holes 511*a* formed adjacent the inner side of the lower end of the cylinder body 511, and the second supporting member 514 is connected as the end of the ribs 514*a* are inserted into each insertion hole 511*a*.

The rotary member 520 is connected to the rotating means 510 to be rotated together therewith. As shown in FIG. 4, the rotary member 520 is disposed separated from the end of the grill member 400 by a predetermined distance. Accordingly, the upwardly returning air current of the dust receptacle 30 flows into the space between the end of the grill member 400 and the rotary member 520, thereby rotating the rotary fan 512.

At this time, the dust entrained in the upwardly returning air current is reflected by the rotary member 520 back into the vortex current. Preferably, the rotary member 520 takes the form of a conical rotary plate for preventing the direction of travel of the dust from being reversed, and has a connecting hole 521 formed at the center through which the end of the shaft 512*a* of the rotary fan 512 is press-fit. Accordingly, together with the rotary fan 512, the rotary member 520 is rotated.

One side of the brush member 530 is connected to the rotary member 520, while the other end thereof is in contact with the grill portion 430 of the grill member 400. Accordingly, the brush member 530 removes the dust and foreign substances from the grill portion 430 while being rotated together with the rotary member 520. The brush member 530 has a lever portion 531 connected to the rotary member 520, and a brush portion 532 connected to the lever portion 531.

According to the preferred embodiment of the present invention, the cyclone-type dust collecting apparatus has at least two brush members 530, 530A that are disposed oppositely to each other. Further provided is a resilient member 533 for resiliently biasing the two brush members 530, 530A to tightly contact the grill portion 420 of the grill member 400. The resilient member 533 can be formed of proper members, for example, a rubber ring, which are disposed on the lever portion 531 of the two brush members 530, 530A. The operation of the cyclone-type dust collecting apparatus constructed as above according to the present invention will be described below with reference to FIGS. 1 and 4.

As shown in FIG. 1, the cyclone-type dust collecting apparatus according to the present invention is mounted on the extension pipe 1*a*, 1*b* of the vacuum cleaner. As the cleaning operation begins, the dust-laden air is drawn from the surface to be cleaned to the cyclone body 20 via the extension pipe 1*a*, the first connecting pipe 21 and the air inlet 23 in a diagonal direction with respect to the cyclone body 20. As the air is drawn in the diagonal direction, a vortex current is formed in the cyclone body 20, and accordingly, some dust and foreign substances are separated from the drawn air by the centrifugal force generated from the vortex current, and are collected in the dust receptacle 30.

The drawn air is then passed through and between the end of the grill member 400 and the rotary member 520, the grill portion, the air outlet 24 and the second connecting pipe 22 by the upwardly returning air current rising from the bottom of the dust receptacle 30, and discharged into the cleaner body. During this process, the rotary fan 512 is rotated by the air current passing through between the end of the grill member 400 and the rotary member 520 to flow into the grill member 400, and accordingly, the brush member 530 connected with the rotary fan 512 and the rotary member 520 is rotated. As the brush portion 532 of the brush member 530 is in contact with the grill portion 430 of the grill member 400, the dust and foreign substance is removed from the grill portion 430 as the brush member 530 is rotated during the cleaning operation. As a result, there is no possibility that the grill portion 430 is clogged by the dust, and the user is not inconvenienced because he/she does not have to separately remove the dust from the grill portion 430.

Meanwhile, some dust and foreign substances, entrained in the air current of the dust receptacle 30, is reflected by the rotary member 520 into the vortex so that the dust and foreign substances are again swirled within the vortex. At this time, since the rotary member 520 is rotated, the reverse travel of the dust and foreign substance can be prevented more efficiently.

Some dust and foreign substances, still remaining in the upwardly rising air beyond the rotary member 520, is filtered out by the grill portion 430. More specifically, as the upwardly rising air is discharged through the grill portion 430 of the grill member 400, some dust and foreign substances that are larger than the fine holes of the grill portion 430 are reflected back into the vortex current.

The remaining dust and foreign substances, which still remain in the air current, become discharged through the grill portion 430 of the grill member 400 and the air outlet 24. The dust and foreign substances are filtered out at the paper filter of the cleaner body, and clean air is discharged outside of the vacuum cleaner via the motor.

As described above, according to the present invention, as the cleaning operation begins, the brush member 530 is rotated by the vortex air current formed inside of the cyclone-type dust collecting apparatus, thereby removing the dust and foreign substances from the grill portion 430 of the grill member 400. Accordingly, the grill portion 430 of the grill member 400 is prevented from being clogged by the dust and foreign substances, and as a result, thereby preventing suction force deterioration and overload of the motor that previously resulted from the clogging of the grill portion 430.

According to the present invention, since the dust and foreign substances can be automatically removed from the grill portion 430 of the grill member 400 during the cleaning operation, the user need not have perform separate manual operations to remove the dust and foreign substances from the grill portion 430. Accordingly, the convenience to the user of the inventive vacuum cleaner improves.

Although the preferred embodiment of the present invention has been described, it will be understood by those skilled in the art that the present invention should not be limited to the described preferred embodiment, but various changes and modifications can be made so that a device may remain within the spirit and scope of the present invention as defined by the appended claims.

What is claimed is:

1. A cyclone-type vacuum cleaner, comprising:

a cyclone body comprising:

a first connecting pipe for connection to an extension pipe at a suction port side of the vacuum cleaner;

a second connecting pipe for connection to an extension pipe at a cleaner body side;

an air inlet interconnected with the first connecting pipe; and an air outlet interconnected with the second connecting pipe;

the cyclone body for forming a vortex comprising dust-laden air drawn in through the air inlet;

a dust receptacle removably connected to the cyclone body, for collecting the dust and foreign substances separated from the dust-laden air by the centrifugal force the vortex;

a first grill body operatively coupled to the cyclone body, said first grill body being cone-shaped, the inside diameter of which decreases from top to bottom;

a second grill body extending from a lower portion of the first grill body, said second grill body having a plurality of fine holes in an upper portion through which air passes, and a closed lower portion;

an air-driven cleaning brush assembly that rotates about the outside of the upper portion of the second grill body and which contacts the fine holes in the upper portion of the second grill body as it rotates;

a fan, located within the closed lower portion of the second grill body, said fan being attached to a shaft that extends to and which is attached to a rotary member at a lower end of the lower portion, said rotary member being coupled to said cleaning brush assembly;

whereby air drawn through said closed lower portion and into the cyclone body causes said fan to rotate said shift, the rotation of said shift causing the rotary member to rotate the cleaning brush assembly around the fine holes in the upper portion of the second grill body.

2. The cyclone-type dust collecting apparatus of claim 1, wherein the cleaning brush assembly is comprised of first and second supporting members, each of which is comprised of at least two ribs and first and second shaft holes formed at a hub through which said shaft extends and which is defined by the center portions of the ribs, for supporting the shaft of the rotary fan, the first supporting member is integrally formed with one end of the cylinder body and the second supporting member is removably connected in an insertion hole formed inside of another end of the cylinder body.

3. The cyclone-type dust collecting apparatus of claim 2, wherein the first and second supporting members comprise three ribs.

4. The cyclone-type dust collecting apparatus of claim 1, wherein the rotary member is formed in the shape of a conical rotary plate, the conical rotary plate having a connecting hole formed at a center through which an end of the shaft of the rotary fan extends.

5. The cyclone-type dust collecting apparatus of claim 1, wherein the cleaning brush assembly is comprised of a lever portion connected with the rotary member, and a brush portion connected to an end of the lever portion.

6. The cyclone-type dust collecting apparatus of claim 5, wherein the cleaning brush assembly further comprises at least two brush portions that are disposed opposite to each other, and a resilient member is further provided to resiliently bias each brush portion to push the two brush portions toward tight contact with the fine holes in the upper portion of the second grill body.

7. The cyclone-type dust collecting apparatus of claim 6, wherein the resilient member is a rubber ring.

8. A cyclone vacuum cleaner comprising:

a dust receptacle that collects dust and substances that are separated from air by a vortex formed in a cyclone body;

a cyclone body operatively coupled to said dust receptacle and comprising:

a first connecting pipe for connection to an extension pipe at a suction port side of the vacuum cleaner;

a second connecting pipe for connection to an extension pipe at a cleaner body side;

an air inlet interconnected with the first connecting pipe; and an air outlet interconnected with the second connecting pipe;

the cyclone body forming a vortex comprising dust-laden air drawn in through the air inlet;

a cone-shaped first grill body operatively coupled to the cyclone body, said cone-shaped first grill body having an inside diameter which decreases from top to bottom;

a second grill body extending from a lower portion of the cone-shaped first grill body, said second grill body having an upper portion comprised of a plurality of fine holes through which dirt-laden air passes, and a closed lower portion;

a cleaning brush that rotates about the outside of the upper portion of the second grill body and which contacts the fine holes in the upper portion of the second grill body as it rotates and removes dirt particles therefrom;

a fan located within the closed lower portion of the second grill body, said fan being attached to a shaft that extends to and which is attached to a rotary member at a lower end of the lower portion, said rotary member rotating with said shaft and being coupled to said cleaning brush;

whereby air drawn through said closed lower portion and into the cyclone body causes said fan to rotate said shaft, the rotation of said shaft causing the rotary member to rotate the cleaning brush around the fine holes in the upper portion of the second grill body.

* * * * *